US005612662A

United States Patent [19]

Drekmeier et al.

[11] Patent Number: 5,612,662

[45] Date of Patent: Mar. 18, 1997

[54] THERMAL FUSE AND METHOD FOR ITS ACTIVATION

[75] Inventors: Karl G. Drekmeier, Unterhaching; Gerhard Winter, München, both of Germany

[73] Assignee: Siemens Aktiengesellschaft, Munich, Germany

[21] Appl. No.: 384,821

[22] Filed: Feb. 7, 1995

Related U.S. Application Data

[63] Continuation of PCT/DE92/00662, Aug. 7, 1992.

[51] Int. Cl. [6] ..... H01H 37/46; H01H 37/76; H01H 37/60; H01H 69/02

[52] U.S. Cl. ..... 337/389; 337/390; 337/391; 337/407; 29/623

[58] Field of Search ..... 337/389, 390, 337/391, 365, 401, 404, 405, 406, 407; 29/623

[56] References Cited

U.S. PATENT DOCUMENTS

| | | | |
|---|---|---|---|
| 2,790,049 | 4/1957 | McAlister . | |
| 3,198,914 | 8/1965 | Baran . | |
| 3,569,892 | 3/1971 | Ripamonti | 337/407 |
| 3,613,040 | 10/1971 | Fluder et al. . | |
| 3,763,454 | 10/1973 | Zandonatti . | |
| 3,827,014 | 7/1974 | Wehl | 337/407 |
| 4,433,231 | 2/1984 | Balchunas | 337/405 |
| 4,536,641 | 8/1985 | Chan | 337/407 |

FOREIGN PATENT DOCUMENTS

| | | |
|---|---|---|
| 1515624 | 4/1970 | Germany . |
| 2548141 | 4/1978 | Germany . |
| 3825897 | 2/1992 | Germany . |
| 2077500 | 12/1981 | United Kingdom . |

*Primary Examiner*—Leo P. Picard
*Assistant Examiner*—Stephen T. Ryan
*Attorney, Agent, or Firm*—Herbert L. Lerner; Laurence A. Greenberg

[57] ABSTRACT

A thermal fuse includes a leaf spring formed of a narrow sheet metal strip. The leaf spring has ends and at least two contact points at the ends. At least one of the contact points is a soldering point for connection with corresponding circuit contacts of a circuit substrate. The leaf spring has at least one spring arm interconnecting the contact points. The spring arm has a roof-shaped deformation in the vicinity of one contact point. The spring arm has a flat and elongated spring segment with a transition adjoining the deformation and a transition extending to the other contact point. The spring segment is bending resistant in the vicinities of the transitions, for transforming a compressive deformation applied to the roof-shaped deformation into a lateral movement and into an arching of the spring segment, with both ends of the leaf spring attached to the circuit substrate without pretensioning. A method for activation of the thermal fuse includes placing the contact points of the leaf springs free of tension on the circuit contacts, soldering the contact points to the circuit contacts, and compressively deforming the roof-shaped deformation after the soldering for creating an arching of the spring segment and a desired pretensioning.

18 Claims, 6 Drawing Sheets

THERMAL FUSE AND METHOD FOR ITS ACTIVATION

CROSS-REFERENCE TO RELATED APPLICATION

This application is a Continuation of International Application Ser. No. PCT/DE92/00662, filed Aug. 7, 1992.

BACKGROUND OF THE INVENTION

Field of the Invention

The invention relates to a thermal fuse for attachment to a circuit substrate, including a leaf spring formed from a narrow sheet metal strip having two ends with contact points at the ends, at least one of the contact points being a solder point for connection to corresponding circuit contacts of the substrate, and at least one spring arm being a link between the contact points. The invention also relates to a method for activation of such a thermal fuse.

Such fuses are used to protect circuit parts against excess thermal stress and can be used on any given circuits, e.g., on circuit boards. However, film and especially hybrid integrated circuits are the preferred area of application of the thermal fuse of the invention.

Thermal fuses of the kind mentioned above are commonly known, e.g., from German Published, Prosecuted Application DE-AS 1 15 624. In the fuse which is used therein for a resistor, the spring arm is pretensioned in its working position during installation of the fuse, i.e., the spring arm must be held in the pretensioned position by a special device during soldering and until the solder joint cools. That requires a complicated manipulation and costly equipment, especially in the case of film circuits.

In order to avoid soldering under tension, thermal fuses disclosed in German Patent DE 38 25 897 C2 and German Published, Non-Prosecuted Application DE 39 30 819 A1 propose holding spring arms of a fuse strap in their pretensioned position by means of a molded buttressing, so that no tightening or holding equipment is necessary during the soldering. However, the buttressing must be removed or bent free after the soldering, so that the tension of the spring arms can take effect. Furthermore, in most applications such very serviceable thermal fuses have a space requirement which is hardly available in many cases, due to their configuration with two spring arms being separated from each other and with a buttressing molded in between, so that they can only be used with difficulty, if at all, when space conditions are constricted.

SUMMARY OF THE INVENTION

It is accordingly an object of the invention to provide a thermal fuse and a method for its activation, which overcome the hereinafore-mentioned disadvantages of the heretofore-known devices and methods of this general type, which require neither maintaining a pretension during soldering nor a buttressing for itself and which are especially suitable for miniaturized constructions with constricted space conditions.

With the foregoing and other objects in view there is provided, in accordance with the invention, a thermal fuse, comprising a leaf spring formed of a narrow sheet metal strip; the leaf spring having ends and at least two contact points at the ends, at least one of the contact points being a soldering point for connection with corresponding circuit contacts of a circuit substrate; the leaf spring having at least one spring arm interconnecting the contact points; the at least one spring arm having a roof-shaped deformation in the vicinity of one of the contact points; and the at least one spring arm having a flat and elongated spring segment with a transition adjoining the deformation and a transition extending to the other of the contact points, the spring segment being bending resistant or stiff-bending in the vicinities of the transitions, for transforming a compressive deformation applied to the roof-shaped deformation into a lateral movement and into an arching of the spring segment, with both of the ends of the leaf spring attached to the circuit substrate without pretensioning.

With the objects of the invention in view, there is also provided a method for activation of a thermal fuse, which comprises placing the contact points of the leaf springs free of tension on circuit contacts of a circuit substrate; soldering the contact points to the circuit contacts; and compressively deforming the roof-shaped deformation after the soldering for creating an arching of the spring segment and a desired pretensioning.

In the invention, the leaf spring of the thermal fuse is not pretensioned and the pretensioning of the leaf springs is generated only after attachment of the leaf springs to the circuit substrate. Thus, it requires neither a pretensioning holder nor a buttressing configuration. As a result of this, and also the configuration of the thermal fuse of the invention with a roof-shaped deformation which can be integrated easily and in a space-saving fashion into a narrow metal strip, and with an adjoining spring segment which stores the spring force, the shape of the leaf spring is especially simple and economical in fabrication and in manipulation during soldering.

In accordance with still another feature of the invention, the leaf spring, which is disposed in a panel strip without pretensioning, is separated from the strip only just prior to attachment to the circuit substrate. The thus single leaf spring, but tacked in position, is then positioned by means of an insertion machine in true position on the appropriately prepared insertion point on the circuit substrate, e.g., in the panel. The entire assembly process, because of the advantageous geometry and the configuration of the leaf springs in a panel strip, can occur fully automatically. The soldered thermal fuses, which are attached to a panel or a single substrate, are then pretensioned by compressive deformation of the roof-shaped geometry element either individually or jointly in a single work step.

The pretensioning process can be carried out in an especially simple manner on the circuit substrate, with the transformation of the compressive deformation of the roof-like deformation into a lateral movement and into an arching of the spring segment being supported in advantageous fashion by the stiff-bending transitions of the spring segment to the roof-shaped deformation and to the other contact point. This enables an integration of the elements of the leaf spring that generate the pretensioning into a narrow metal strip, so that the thermal fuse of the invention requires only little space and, consequently, is well suited to miniaturized structures with constricted space conditions.

In accordance with another feature of the invention, in an advisable and favorable embodiment with respect to the deformability of the deformation and of the spring segment, the roof-shaped deformation is formed by two legs that are roughly perpendicular to each other and are joined by means of a roof ridge.

In accordance with a further feature of the invention, the cross section of the roof-shaped deformation is reduced from at least the cross section of the adjacent spring segment. In this case, the roof-shaped deformation with reduced cross section will cooperate with the stiff-bending passages to allow the transformation of the deformation path in an advantageous and reproducible fashion into a multiple of the spring path of one end of the spring arm, and it is possible to adjust the spring path by using different deformation lengths in the pretensioning.

It is also advisable to reduce the cross section of the roof-shaped deformation with respect to the adjacent contact point.

In accordance with an added feature of the invention, especially favorable stability conditions for the reproducible transformation of a deformation from the direction in which the pressure is exerted on the deformation, e.g., from a Z-direction, into the direction of the lateral movement, e.g., into a X-direction, occur if the ratio of the cross section of the roof-shaped deformation to the cross section of the adjoining spring segment is approximately 1:2.

In accordance with an additional feature of the invention, the cross section of the roof-shaped deformation is reduced by making this deformation narrower in its width than the adjoining spring segment, at the transition point. The cross section of the roof-shaped deformation can also be reduced in other ways, e.g., by relieving or recessing.

In accordance with yet another feature of the invention, the desired stiff bending at the transitions of the spring segment is provided by rigidly bending the spring segment near the transition point to the roof-shaped deformation with a radius, and making the spring segment in the area of the transition to the other contact point resistant to bending by crimping.

In accordance with yet a further feature of the invention, the spring segment tapers toward the other contact point.

In accordance with yet an added feature of the invention, with respect to the assembly process for the thermal fuse, it is advantageous if the ends of the leaf spring are fashioned as contact tabs, forming solder connection points lying in a plane.

In this way, the ends of the leaf spring are suitably shaped for an SMD assembly and soldering technique, so that several thermal fuses can be soldered jointly in a single work step in the reflow method.

In accordance with yet an additional feature of the invention, the leaf spring has two parallel spring arms, which form two separate contact points at one end and which are joined together at the opposite end. This suitably configures the thermal fuse as a double spring for adjacent contact points of the circuit substrate, so that the spring arms can produce a breaking of the circuit when the solder melts open at both contact points. This configuration is advantageous and especially reliable for contact points which cannot be placed too closely next to each other.

In accordance with again another feature of the invention, the two adjacent contact points make contact with a leaf spring having only one spring arm, and the leaf spring has a contact tab at one end spanning two separate contact points of the circuit substrate.

In accordance with again a further feature of the invention, the contact points of the leaf spring to be soldered to the circuit substrate have changes in cross section.

In accordance with a concomitant feature of the invention, one end of the leaf spring is additionally fastened to the circuit substrate with a drop of casting resin.

In accordance with another mode of the invention, there is provided a method which comprises arching the spring segment by laterally shifting a bend in the spring segment, resting against the circuit substrate, in its lengthwise direction and away from the roof-shaped deformation.

In accordance with a concomitant mode of the invention, there is provided a method which comprises exerting the compressive force on a ridge of the roof-shaped deformation having two legs.

Other features which are considered as characteristic for the invention are set forth in the appended claims.

Although the invention is illustrated and described herein as embodied in a thermal fuse and a method for its activation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
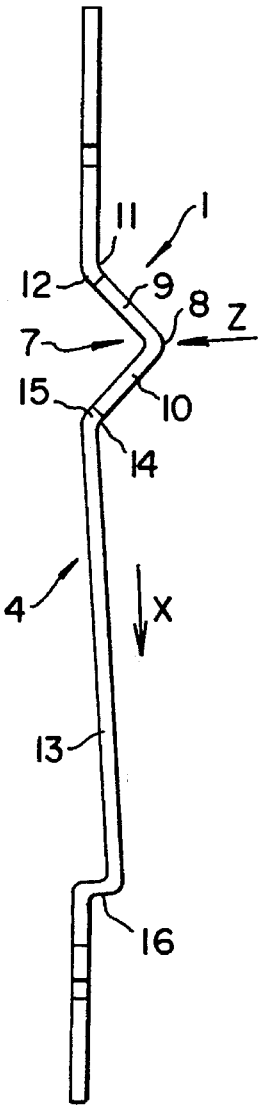
FIGS. 1 and 2 are respective fragmentary, diagrammatic top-plan and side-elevational views of thermal fuses being constructed according to the invention and disposed in a panel strip.
Figure 1:
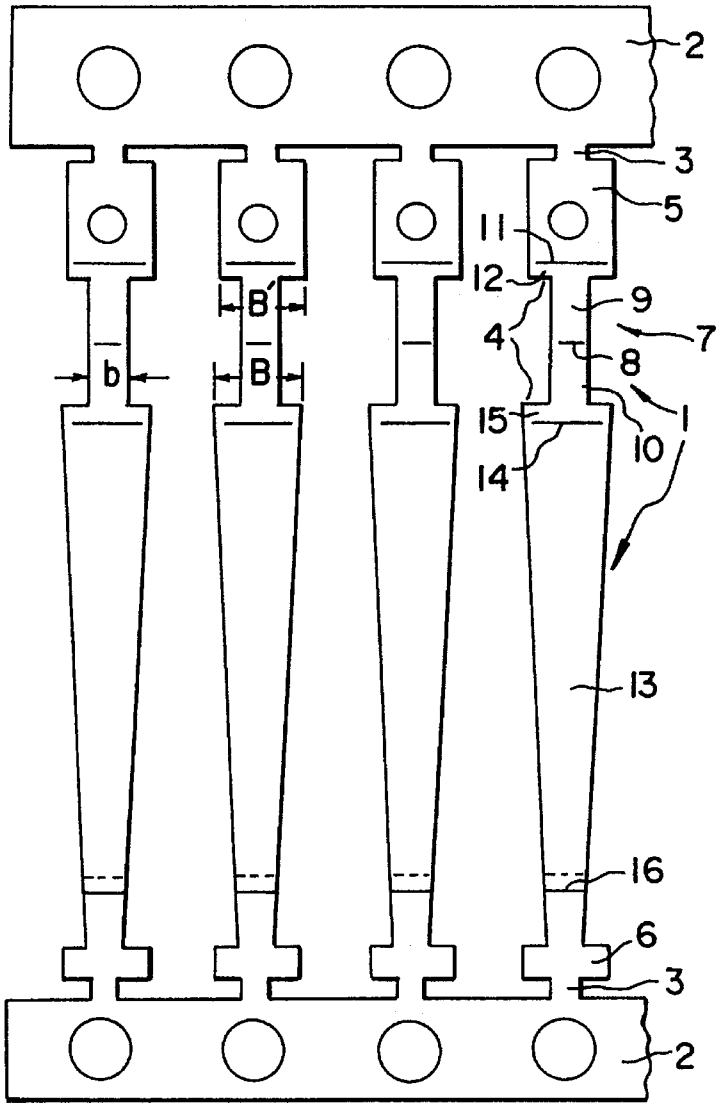

Referring now to the figures of the drawing in detail and first, particularly, to FIG. 1 thereof, there is seen a thermal safety device or fuse formed of a leaf spring 1, made from a sheet bending and punching piece, which is disposed with a number of other leaf springs in a panel strip between two transport strips 2. A separation of a leaf spring 1 is carried out at a ridge 3. FIG. 1 clearly shows a cutout of the leaf spring 1, i.e., a geometrical shape of the sheet metal piece forming a leaf spring. It will be recognized that the leaf spring 1 is formed of a narrow metal strip of the panel and essentially is formed of a spring arm 4, which has a perfectly determined geometrical shape. At either end, the spring arm 4 has contact tabs 5, 6, lying in a plane and forming suitable SMD solder connection points. Near the contact tab 5, the spring arm 4 has a roof-shaped deformation or molding 7, which in this case is formed by two legs 9 and 10 that are roughly perpendicular to each other and are joined at a ridge 8, thus forming a generally V-shape as seen in cross section. However, a roof-shaped deformation can also be produced with other cross sectional forms. As FIG. 1 clearly shows, the roof-shaped deformation 7 is narrower than the contact tab 5, which is bent at a radius 11 near a transition point to the leg 9 of the deformation 7. A bend 12 at the radius 11 merges into the narrower leg 9, so that it effectively forms a broader base for the narrow leg 9. At the other side of the roof-shaped deformation 7, it adjoins a flat and elongated spring segment 13, which extends to the other contact tab 6 in the form of a tapering trapezoid, as is seen in a top view. The spring segment 13 is bent at a radius 14 near a transition point to the roof-shaped deformation 7 and has a step-like crimp 16 in the vicinity of a transition to the contact tab 6. Accordingly, the spring segment 13 in the vicinity of the transition to the deformation 7 and in the vicinity of the transition to the contact tab 6 is resistant to bending, since it has stable angle regions. As FIG. 1 shows, the spring segment 13 at the point of transition to the roof-shaped deformation 7 is distinctly broader than the deformation 7, and a bend 15, like the bend 12 in the case of the contact tab 5, merges into the narrower leg 10 of the deformation 7 and also effectively forms a broad base therefor. Thus, because a width b of the roof-shaped deformation 7 is narrower at each transition point than respective widths B and B' of both the spring segment 13 and the contact tab 5, the cross section of the deformation 7 is reduced. However, a reduction of the cross section can also be accomplished by other means, such as recessing or relieving the legs of the deformation. In the illustrated embodiment example, the widths B and B' are equal in size, and it has been found to be advantageous for the width B or B' to be roughly twice as large as the width b of the deformation 7. In other words, the ratio of the cross section of the deformation to the cross section of the spring segment 13 or to the cross section of the contact tab 5, is about 1:2. As FIG. 2 further shows, the spring segment 13 lies at a slight acute angle relative to the plane of the contact tabs 5 and 6 due to the bending at the radius 14. With the configuration described herein, the leaf spring 1 has a geometrical shape geared to subsequent production of the pretensioning for the thermal fuse.

Figure 4:
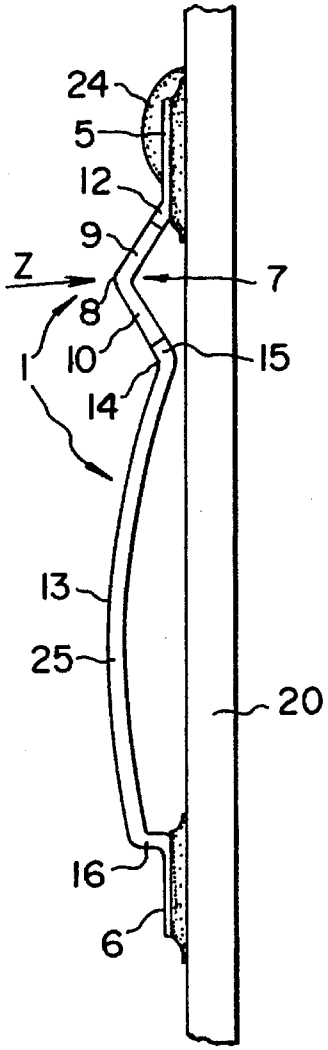
FIGS. 3 and 4 are respective fragmentary top-plan and side-elevational views of a thermal fuse being assembled on an circuit substrate.
Figure 3:
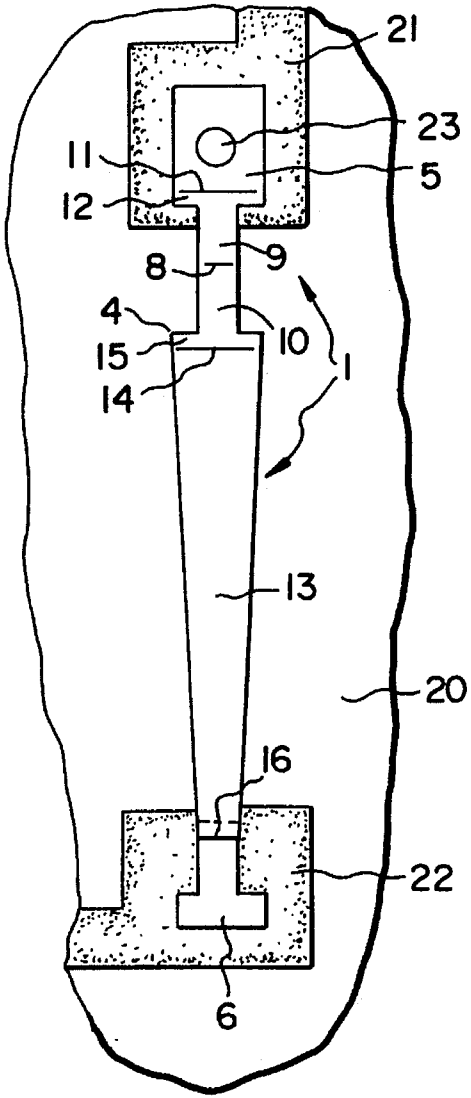
Figure 5:
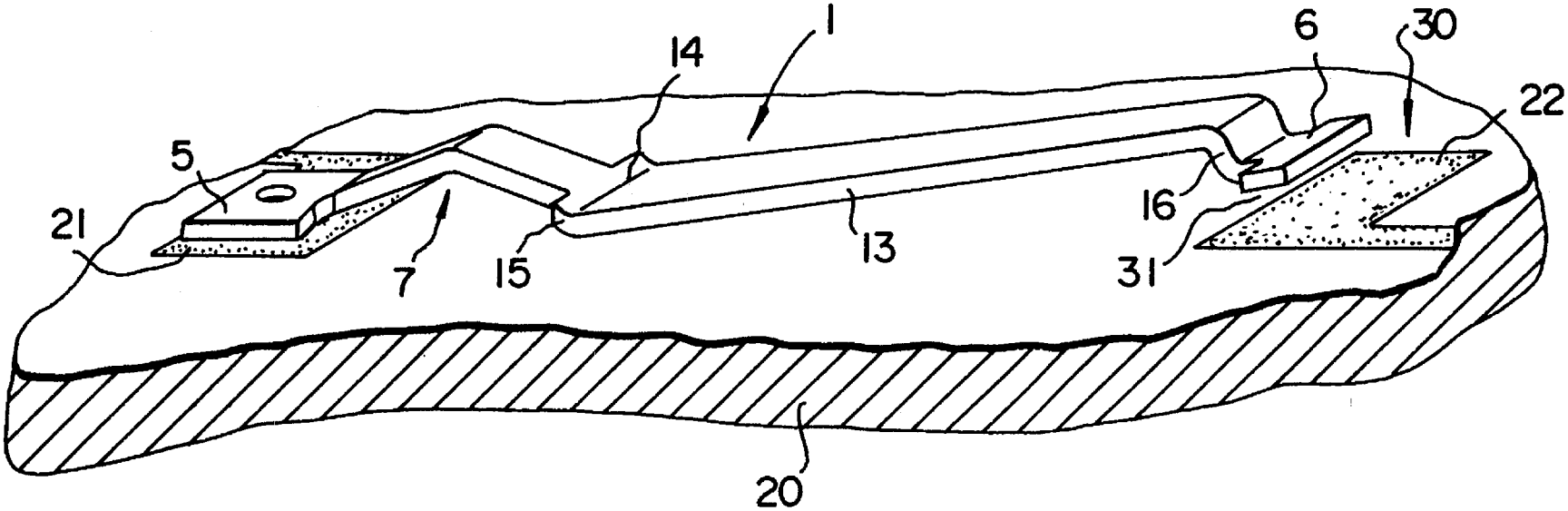
FIG. 5 is a fragmentary, perspective view of a thermal fuse in a released condition.

The leaf springs 1 which are disposed in the panel strip in FIG. 1 and are not pretensioned are only separated from the panel strip immediately before being attached to an IC or circuit substrate 20 shown in FIGS. 3, 4 and 5, e.g., immediately before a hybridization process. The leaf springs 1 which are therefore individual, but are tacked in position, are then positioned by an insertion machine in a true position on an appropriately tin-plated insertion location on the circuit substrate 20, e.g., a hybrid circuit, e.g., on the substrate panel. Due to the geometry and the configuration of the leaf springs in a panel strip, the entire assembly process can be fully automated. Due to the SMD solder connections, a large number of leaf spring thermal fuses can be soldered together in a reflow process. For this purpose, the circuit substrate 20 is configured with appropriate circuit contacts 21 and 22 shown in FIG. 3 for the soldering of the contact tabs 5 and 6 of each leaf spring. It is advisable to support the solder points by a form-locking connection through changes in the cross section at the ends of the leaf spring 1. A form-locking connection is one which connects two elements together due to the shape of the elements themselves, as opposed to a force-locking connection, which locks the elements together by force external to the elements. In this case, this is accomplished by providing the contact tab 5 with a hole 23 and making the contact tab 6 wider than the adjoining end of the spring segment 13. As FIG. 4 shows, the spring end can be further secured to the contact tab 5 with a drop of casting resin 24.

FIGS. 3 and 4 show the leaf spring 1 of a thermal fuse in the pretensioned condition. The pretensioning of one or more thermal fuses being soldered and located on a panel or an individual substrate can be produced individually for each leaf spring or jointly in a single work step by deformation of the roof-shaped deformation 7. For this purpose, the leaf spring shown in FIG. 2 in the non-pretensioned state (which is the state that the leaf spring 1 also assumes in the soldered installation condition) is subjected to a slight compressive force in the direction of an arrow Z, e.g., on the ridge 8 of the deformation 7. This compressive force generates a lateral movement of the spring segment 13 initially thrusting the bend radius 14 against the circuit substrate 20 and producing a sideways shifting of the bend 15 in the lengthwise direction of the spring segment, i.e., in a direction X which is away from the deformation 7. The shifting of the bend 15 is transformed into an arching 25 of the spring segment 13, which is clearly evident in FIG. 4, so that the resulting spring tension is characterized by the arching 25. The ratio between the deformation path in the X-direction and the subsequent spring path of the end of the spring having the contact tab 6 in the relaxed condition can be 1:4, for example. In other words, a deformation path of 2/10 millimeter in the Z-direction produces a spring path in the X-direction of 8/10 millimeter. With this transmission ratio, various spring pathways can be adjusted without altering the actual geometry of the thermal fuse. The stability relationships produced in the thermal fuse of the invention, which are accomplished by the stiff-bending or bending-resistant transitions of the spring segment 13, permit a reproducible transformation of a deformation from the Z-direction into the X-direction. In the pretensioned condition, the leaf spring 1 and therefore the thermal safety device or fuse is then activated.

Given an appropriate intense heating of the protected region of the circuit by an excess load, the solder melts at a tensioning point 30 of the leaf spring 1 shown in FIG. 5, so that the spring segment 13 under pretension is relaxed and lifts away from the circuit substrate 20, thus producing the desired interruption of the circuit and preventing damage to a subassembly. An adjustable spacing 31 of the opening ensures a reliable galvanic circuit-breaking.

Figure 7:
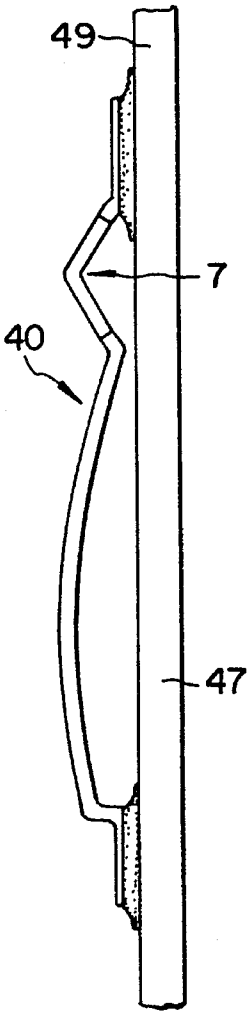
FIGS. 6 and 7 are respective fragmentary top-plan and side-elevational views of another embodiment of a thermal fuse being assembled on a circuit substrate.
Figure 6:
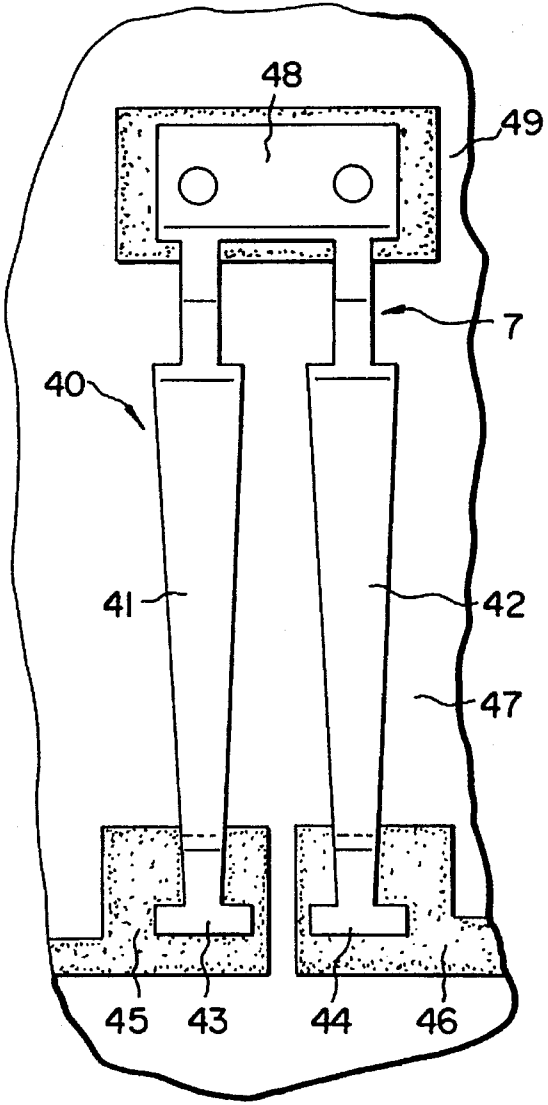

FIGS. 6 and 7 show the thermal fuse as a double spring in a further embodiment. In this case, a leaf spring 40 has two parallel spring arms 41 and 42, which are configured according to the description of FIGS. 1 and 2. At one end, the spring arms 41 and 42 span two separate contact points 45, 46 of the circuit substrate 47 with contact tabs 43, 44 thereof. At another opposite end 48, the spring arms 41 and 42 are joined to each other and attached to a surface 49 of the circuit substrate 47 in a conducting or insulating manner (depending on the circuit). In this configuration and placement, the spring arms 41, 42 can produce the circuit-breaking when the solder melts either at the contact point 45 or at the contact point 46.

Figure 9:
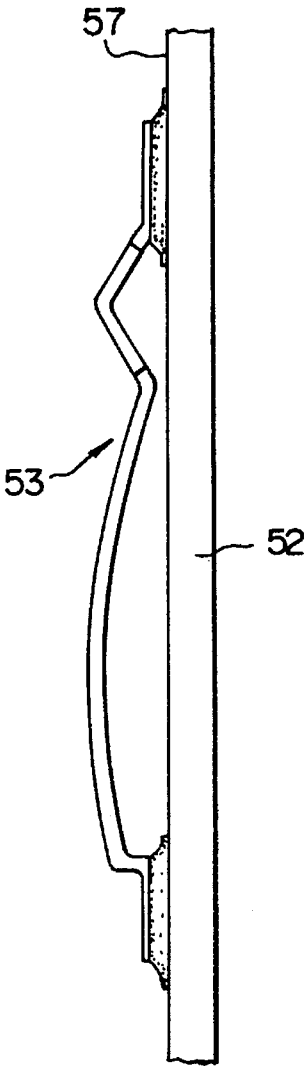
FIGS. 8 and 9 are views similar to FIGS. 6 and 7 of a further embodiment of a thermal fuse.
Figure 8:
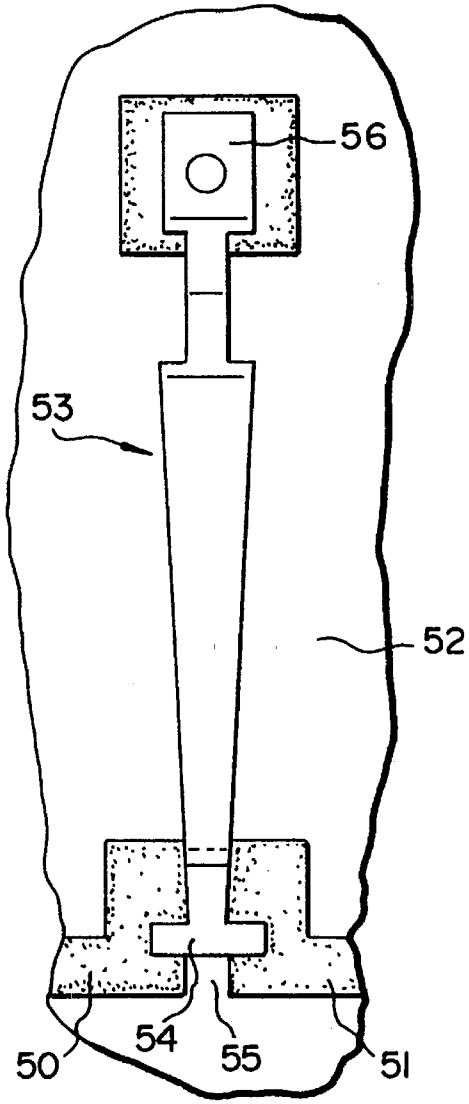

In a further embodiment according to FIGS. 8 and 9, two contact points 50, 51 of a circuit substrate 52 make contact with only one leaf spring 53, due to the fact that a contact tab 54 of the leaf spring (which in other respects is configured like FIGS. 1 and 2) is so wide that it correspondingly spans a distance 55 between the contact points 50, 51. An opposite end 56 of the spring is connected to a surface 57 of the circuit substrate 52 in a conducting or insulating manner (depending on the circuit).

Figure 11:
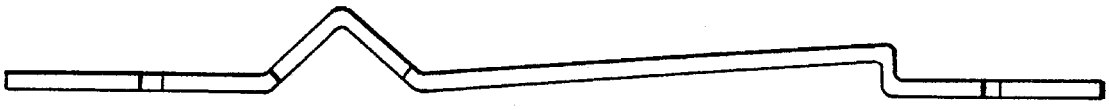
FIGS. 10 and 11 are respective fragmentary top-plan and side-elevational views of various configurations of thermal fuses disposed in a panel strip.
Figure 10:
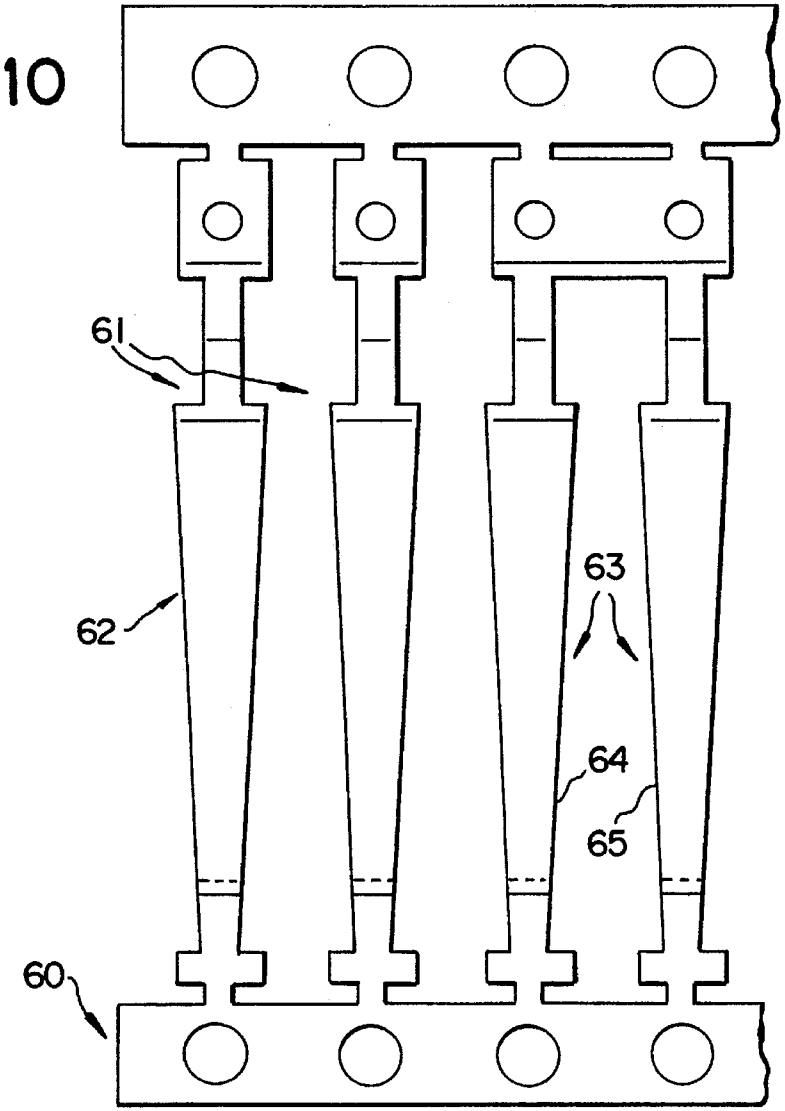

Finally, FIGS. 10 and 11 also represent a panel strip 60 containing both leaf springs 61 each having a single spring arm 62 and leaf springs 63 configured as a double spring with two parallel spring arms 64, 65. This can be accomplished by the drawing of a clipping punch with the same die.

We claim:

1. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points; and said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning.

2. The thermal fuse according to claim 1, wherein said roof-shaped deformation has two legs being approximately perpendicular to each other and a ridge joining said legs.

3. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points;

said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning; and said spring segment having a given cross section, and said roof-shaped deformation having a cross section being reduced at least relative to said given cross section.

4. The thermal fuse according to claim 3, wherein said cross sections of said roof-shaped deformation and said adjoining spring segment are in a ratio of approximately 1:2.

5. The thermal fuse according to claim 3, wherein said roof-shaped deformation has a narrower width than said adjoining spring segment at said transition from said spring segment to said deformation, for reducing said cross section of said roof-shaped deformation.

6. The thermal fuse according to claim 1, wherein said spring segment is bending resistant and has a bending radius in the vicinity of said transition from said spring segment to said roof-shaped deformation.

7. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points;

said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning; and said spring segment being stiffened by a crimp in the vicinity of said transition to the other of said contact points.

8. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points;

said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning; and said spring segment tapering toward the other of said contact points.

9. The thermal fuse according to claim 1, wherein said contact points at said ends of said leaf spring are contact tabs forming solder connection points lying in a plane.

10. The thermal fuse according to claim 1, wherein said contact points of said leaf spring to be soldered to the circuit substrate have changes in cross section.

11. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points;

said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning; and one of said at least two contact points being disposed at one of said ends of said leaf spring and being a contact tab spanning two separate circuit contacts of the circuit substrate.

12. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points;

said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning; and said leaf spring having two parallel spring arms, each of said spring arms being a respective one of said contact points separately disposed thereon at one of said ends of said leaf spring, and said spring arms being joined together at the other of said ends of said leaf spring.

13. The thermal fuse according to claim 1, wherein said leaf spring is disposed in a panel strip from which said leaf spring is removed immediately before being attached to the circuit substrate in a position being determined thereby and in a non-pretensioned condition with an insertion machine.

14. A thermal fuse, comprising:

a leaf spring formed of a narrow sheet metal strip;

said leaf spring having ends and at least two contact points at said ends, at least one of said contact points being a soldering point for connection with corresponding circuit contacts of a circuit substrate;

said leaf spring having at least one spring arm interconnecting said contact points;

said at least one spring arm having a roof-shaped deformation in the vicinity of one of said contact points;

said at least one spring arm having a flat and elongated spring segment with a transition adjoining said deformation and a transition extending to the other of said contact points, said spring segment being bending resistant in the vicinities of said transitions, for transforming a compressive deformation applied to said roof-shaped deformation into a lateral movement and into an arching of said spring segment, with both of said ends of said leaf spring attached to the circuit substrate without pretensioning; and one of said ends of said leaf spring being additionally fastened to the circuit substrate.

15. The thermal fuse according to claim 14, wherein said one end of said leaf spring is additionally fastened to the circuit substrate with a drop of casting resin.

16. A method for activation of a thermal fuse including a leaf spring formed of a narrow sheet metal strip having ends, at least two contact points at the ends, at least one spring arm interconnecting the contact points and having a roof-shaped deformation in the vicinity of one of the contact points, and a flat and elongated spring segment having a transition adjoining the deformation and a transition extending to the other of the contact points and being bending resistant in the vicinities of the transitions, which comprises:

placing the contact points of the leaf springs free of tension on circuit contacts of a circuit substrate;

soldering the contact points to the circuit contacts; and compressively deforming the roof-shaped deformation after the soldering for creating an arching of the spring segment and a desired pretensioning.

17. The method according to claim 16, which comprises arching the spring segment by laterally shifting a bend in the spring segment, resting against the circuit substrate, in its lengthwise direction and away from the roof-shaped deformation.

18. The method according to claim 16, which comprises exerting the compressive force on a ridge of the roof-shaped deformation having two legs.

* * * * *